United States Patent [19]

Schaffer et al.

[11] Patent Number: 4,899,417

[45] Date of Patent: Feb. 13, 1990

[54] ROLLER APPLICATOR WITH FOLDING HANDLE

[76] Inventors: Stanley Schaffer; Bert Schussel, both of 10201 Hammocks Blvd., Store #148, Miami, Fla. 33196

[21] Appl. No.: 238,115

[22] Filed: Aug. 29, 1988

[51] Int. Cl.[4] ..... B05C 17/02; B43M 11/02

[52] U.S. Cl. ..... 15/230.11; 15/143 R; 15/144 R; 29/110.5

[58] Field of Search ..... 15/144 R, 143 R, 144 B, 15/230.11, 244.1; 29/110.5; 132/320; 401/197, 208, 220

[56] References Cited

U.S. PATENT DOCUMENTS

| | | | |
|---|---|---|---|
| 2,892,202 | 6/1959 | Williams | 15/132.5 |
| 3,027,582 | 4/1962 | Pittman | 15/230.11 |
| 4,128,350 | 12/1978 | Gamache | 401/208 |
| 4,150,904 | 4/1979 | Stewart | 401/186 |
| 4,299,005 | 11/1981 | Brown | 15/244 A |
| 4,483,356 | 11/1984 | Kales | 132/320 |
| 4,555,196 | 11/1985 | DeGarmo | 401/220 |
| 4,571,769 | 2/1986 | Ford | 15/230.11 |

*Primary Examiner*—Edward L. Roberts

*Attorney, Agent, or Firm*—Oltman and Flynn

[57] ABSTRACT

A roller applicator for applying lotion to hard-to-reach areas of a person's body. The applicator has a roller, a holder in the form of a bifurcated yoke which rotatably supports the roller, and a folding handle pivoted on the holder. The holder presents a recess for holding the handle when it is folded. Manually releasable detents hold the handle in its extended position with its arms in alignment and extending perpendicular to the roller.

8 Claims, 1 Drawing Sheet

ROLLER APPLICATOR WITH FOLDING HANDLE

SUMMARY OF THE INVENTION

This invention relates to a roller applicator for applying lotion or the like to hard-to-reach areas of a person's body, such as the back.

In accordance with this invention, the applicator has a roller for spreading lotion or other substance, a holder rotatably supporting the roller and presenting a recess which opens away from the roller, and a folding handle which is adjustable between a folded position stored in the holder recess and an extended position projecting away from the holder and the roller. Preferably, detents are provided for manually releasably locking the arms of the folding handle in alignment and extending substantially perpendicularly from the holder and the roller.

A principal object of this invention is to provide a novel roller applicator for use on hard-to-reach areas of a person's body to apply a lotion, such as sun tan oil or the like.

Another object of this invention is to provide such an applicator having a folding handle which is adjustable between a folded, stored position in the applicator and an extended position projecting away from the roller in the applicator.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 3:
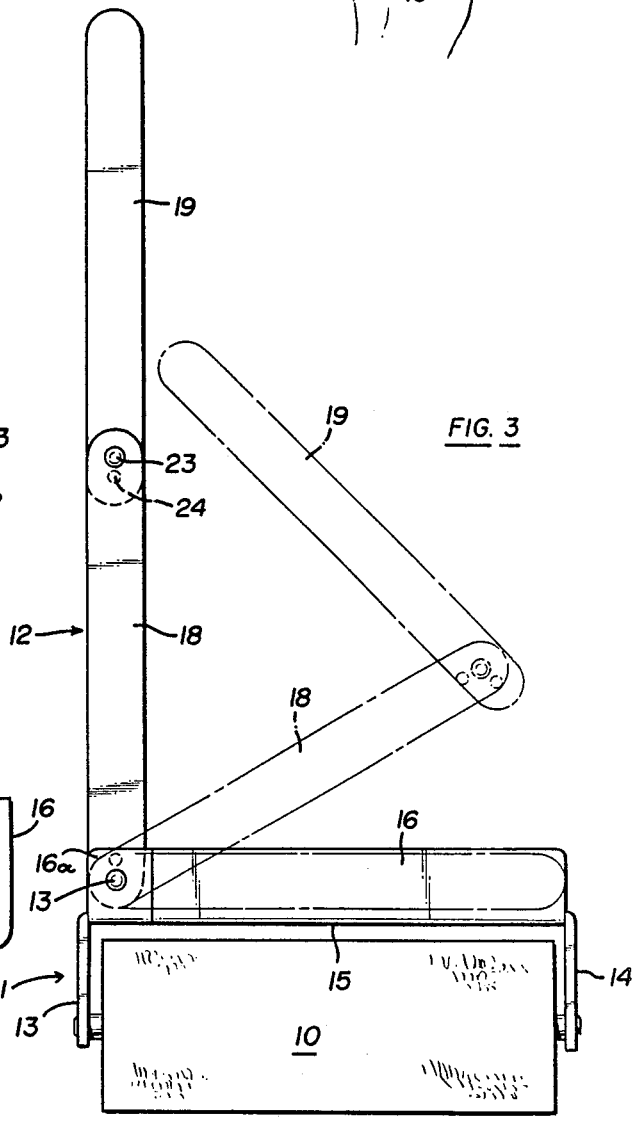
FIG. 3 is a front elevation of the applicator showing the handle in its fully extended position in full lines and partly folded in phantom lines.

Referring to FIG. 3, the applicator of the present invention has a cylindrical roller 10 of any suitable material for contact with a person's skin, a holder in the form of a bifurcated yoke 11 rotatably supporting the roller, and a folding handle 12 pivotally connected at 13 to the holder 11.

The holder 11 has flat legs 13 and 14 at its opposite ends and a flat bridging wall 15 extending between legs 13 and 14 and spaced a short distance from the roller along its length. The roller 10 is located between the end legs 13 and 14 of holder 11 and is rotatably supported by them. The holder also has parallel flat front and back walls 16 and 17 (FIGS. 1 and 2) with inwardly-offset segments **16*a* and 17*a* at the end where pivot 13 is located. Walls 16 and 17 are joined to the bridging wall 15 of the holder and extend perpendicular to it away from roller 10. Thus, the holder walls 15,16 and 17 form a channel with a recess that extends the full length of roller 10** and is open at the side of the channel away from the roller.

The folding handle 12 has flat, elongated, inner and outer arms 18 and 19.

At its lower end in the drawing, the inner arm 18 is received between the inwardly-offset end segments **16*a* and 17*a* of the holder channel, and there it is pivotally connected at 13 to the holder. A short distance from this pivot the inner arm 18 carries a hemispherical protrusion 20 on the front (FIG. 4) which has a snap fit in a complementary recess 21 on the inside of front wall segment 16*a* when the inner arm 18 extends perpendicular to the bridging wall 15 of the holder. Near its outer end, the inner arm 18 has a hemispherical recess 22 on the back. Outwardly past the recess, the inner arm 18 is pivotally connected at 23 to the outer arm 19**.

Figure 4:
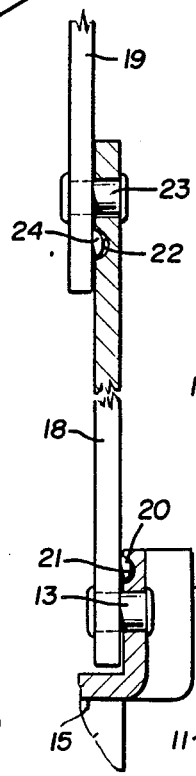
FIG. 4 is a partial end elevation taken from the left end of FIG. 3 and with certain parts broke away for clarity.

The outer arm 19 carries a hemispherical protrusion 24 on the front near its inner end which has a snap fit in recess 22 in the inner arm 18 when the outer arm 19 is aligned with the inner arm 18, as shown in FIG. 4 and in full lines in FIG. 3.

The inner and outer arms 18 and 19 are substantially equal in length, and this length is substantially equal to the length of the channel recess defined by the holder walls 15,16 and 17.

Figure 1:
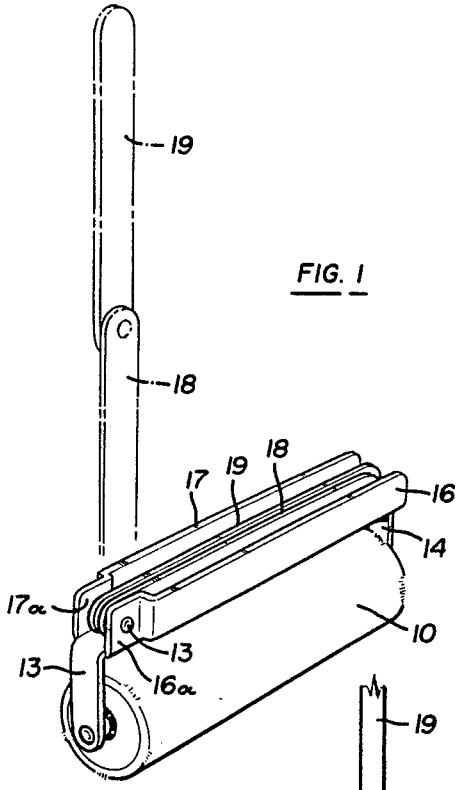
FIG. 1 is a perspective view of the present roller applicator with its handle folded.
Figure 5:
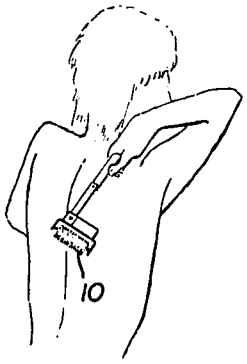
FIG. 5 is a perspective view showing a person using the present applicator.
Figure 2:
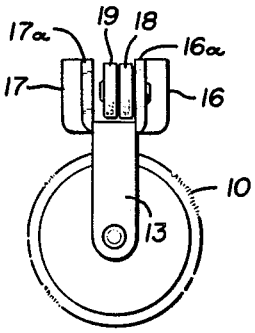
FIG. 2 is an end elevation taken from the left end of FIG. 1.

The handle 12 can be folded into this channel recess in holder 11 when the applicator is not in use, as shown in FIGS. 1 and 2.

When the applicator is to be used, the handle 12 can be pulled out of the channel recess in holder 11 and unfolded to the extended position shown in full lines in FIG. 3, in which its inner arm 18 extends perpendicularly away from the bridging wall 15 of the holder and the outer arm 19 extends out from the inner arm 18 and is aligned with it. In this extended position of the handle, the rounded protrusion 20 on its inner arm 18 is seated in recess 21 on the holder, and the rounded protrusion 24 on the outer arm 19 is seated in recess 22 in the inner arm 18, as shown in FIG. 4. Thus, these rounded protrusions form detents of well-known design for holding the handle in its straight, extended position until a person purposely folds up the handle.

We claim:

1. An applicator comprising:

a roller;

a holder rotatably supporting said roller and presenting a recess which is open along one side away from the roller;

and a folding handle pivoted to said holder and selectively adjustable between a folded position seated in said recess in the holder and an extended position projecting away from said holder and said roller.

2. An applicator according to claim 1 wherein said recess in the holder extends substantially the full length of said roller.

3. An applicator according to claim 2 and further comprising manually releasable means for locking said folding handle in said extended position.

4. An applicator according to claim 3 wherein said holder is a bifurcated yoke having opposite legs at opposite ends of said roller, a bridging wall extending between said legs on one side of said roller, and front and back walls extending substantially perpendicularly from said bridging wall away from said roller, said front, back and bridging walls of the holder forming said recess for receiving the folded handle.

5. An applicator according to claim 2 wherein said handle comprises:

an inner arm pivoted at one end to said holder;

and an outer arm pivoted at one end to the opposite end of said inner arm;

and further comprising:

manually releasable detent means acting between said holder and said inner arm to hold said inner arm extending substantially perpendicularly away from said holder;

and manually releasable detent means acting between said inner and outer arms to hold said outer arm extending away from and aligned with said inner arm.

6. An applicator according to claim 5 wherein said holder is a bifurcated yoke having opposite legs at opposite ends of said roller, a bridging wall extending between said legs on one side of said roller, and front and back walls extending substantially perpendicularly from said bridging wall away from said roller, said front, back and bridging walls of the holder forming said recess for receiving the folded handle.

7. An applicator according to claim 1 and further comprising manually releasable means for locking said folding handle in said extended position.

8. An applicator according to claim 7 wherein said holder is a bifurcated yoke having opposite legs at opposite ends of said roller, a bridging wall extending between said legs on one side of said roller, and front and back walls extending substantially perpendicularly from said bridging wall away from said roller, said front, back and bridging walls of the holder forming said recess for receiving the folded handle.

* * * * *